US008405324B2

(12) United States Patent
Beers et al.

(10) Patent No.: US 8,405,324 B2
(45) Date of Patent: Mar. 26, 2013

(54) HOSPITAL LIGHTING WITH SOLID STATE EMITTERS

(75) Inventors: William Winder Beers, Chesterland, OH (US); Mark Elton Duffy, Shaker Heights, OH (US)

(73) Assignee: General Electric Company, Schenectady, NY (US)

( * ) Notice: Subject to any disclaimer, the term of this patent is extended or adjusted under 35 U.S.C. 154(b) by 342 days.

(21) Appl. No.: 12/818,460

(22) Filed: Jun. 18, 2010

(65) Prior Publication Data

US 2011/0309773 A1 Dec. 22, 2011

(51) Int. Cl.
*H05B 37/00* (2006.01)
*F21V 9/00* (2006.01)
*H01J 61/94* (2006.01)

(52) U.S. Cl. ..... 315/312; 362/231

(58) Field of Classification Search ..... 315/312, 315/192; 362/231, 247, 341, 230, 84, 257; 313/501, 500, 498

See application file for complete search history.

(56) References Cited

U.S. PATENT DOCUMENTS

2007/0223219 A1 9/2007 Medendorp, Jr. et al.
2009/0195137 A1 8/2009 Brandes

OTHER PUBLICATIONS

SL, Svea DC Dome 7-LED, Datasheet Svea DC Dome 32-36VDC, May 19, 2009, OptoDrive, pp. 1-20.*
OptoDrive Brochure, "New light. Superbly balanced and colour corrected LED modules for medical use", Light measured date: Aug. 25, 2009, pp. 1-16.*

* cited by examiner

*Primary Examiner* — Daniel D Chang
(74) *Attorney, Agent, or Firm* — Fay Sharpe LLP

(57) ABSTRACT

A solid state light emitting-based illumination system which, when energized, exhibits a correlated color temperature (CCT) in the range of between about 3300° K and about 5300° K, and exhibits a COI of less than 3.3 is provided. The system comprises two or more solid state elements, and is configured to provide a total light that appears white when energized, the combined light having preselected spectral fraction values such that when combined the emission meets the specified CCT and COI standards. A method for combining individual solid-state light emitters is also provided.

20 Claims, 9 Drawing Sheets

HOSPITAL LIGHTING WITH SOLID STATE EMITTERS

BACKGROUND OF THE DISCLOSURE

The present invention relates to a solid-state illumination system, and more particularly, to a solid-state illumination system for use in hospital or other clinical observation areas. It is to be understood, however, that the invention disclosed herein has utility and application in related areas and with additional lighting systems.

Solid-state lighting provides a potentially higher efficiency light source, as compared to conventional discharge-type lamps, and further provides the capability of adjusting spectral characteristics to obtain specific desirable features. Of particular interest herein is the use of solid-state lighting in clinical observation areas, including hospital examination rooms and other clinical settings, where lighting plays an important role in the observation of skin visual appearance to aid in patient assessment.

Clinical observation is an important aspect of assessing a patient's condition, and the available lighting plays a critical role in the accurate assessment of the visual appearance of a patient's skin, including the detection of cyanosis. Cyanosis is a blue coloration of the skin and mucous membranes due to the presence of deoxygenated hemoglobin in blood vessels near the skin surface. Lack of blood oxygenation is an indicator of many potentially harmful medical conditions, some of which may be fatal. Cyanosis can occur in the fingers, as well as other extremities (referred to as peripheral cyanosis), or in the lips and tongue (referred to as central cyanosis).

Fully oxygenated blood generally appears a shade of red. However, when blood is deoxygenated the optical properties of skin distort the dark red color making the skin appear bluish. During cyanosis, tissues that would normally be filled with bright oxygenated blood are instead filled with darker, deoxygenated blood. The scattering of light that produces the blue hue is similar to the process that renders coloration in other objects, i.e. certain wavelengths (colors) dominate the reflected spectrum while others are mostly absorbed. Darker blood absorbs more red wavelengths causing a blue-shifting optical effect, and thus oxygen deficiency leads to an observable blue discoloration of the lips and other mucous membranes.

The color characteristics of lamps used in the electric lighting of hospitals and clinical settings, where observed changes in patient skin appearance are critical, play a significant role in providing the necessary visual conditions for color discrimination-based tasks. In order for cyanosis to be accurately detected, the lighting in such settings should be white, so that the coloration of skin detected by the observing caregiver is not influenced by lighting that inherently casts a dominant hue.

Due to the importance of lighting to accurate patient assessment in clinical observation settings, and more particularly to the need to avoid misdiagnosis of the condition of cyanosis, it was determined that standards should be established to guide hospitals and clinics in choosing appropriate lighting for the purpose of patient observation. The original hospital and medical task lighting standard was established in the early 1970s, based on clinical trials undertaken at the Royal Prince Alfred Hospital in Sydney, to determine optimum lamp color characteristics for tubular fluorescent lamps in use in clinical cyanosis evaluation settings. The result of this initial study was the publication of the standard AS1765: 1975. The lamps at that time were predominantly halophosphate type lamps which exhibit a relatively continuous spectral energy distribution. The results of this trial, established the parameters within which correlated color temperature, and color rendering index values, Ra and R13, should lie to provide light that allows accurate assessment of the presence of cyanosis.

Later, triphosphor lamps were developed. These lamps emit most of their light output in three distinct wavelength bands, with greatly reduced emissions at other wavelengths. The wavelengths of interest for cyanosis detection purposes fall between 620 nm and 700 nm. If the proportion of light emitted in this range is too small, the red coloration of blood is not evident and any change caused by reduced oxygen content may not be seen. Conversely, if there is an excess of light emitted in this range, the patient will always appear well, giving a false result as well. With reference to FIG. 1, which provides a comparison of the spectral power distribution of various lighting sources, it is seen that neither the triphosphor lamp nor the halophosphor lamp generates output in the cyanosis detection wavelength range, i.e., 620 nm-700 nm.

To develop the standard, blood samples having various percentages of oxygenation were tested to determine the spectral reflectance of the blood. The testing was set up to cover 5 nm intervals of emitted light wavelength. In this study, most of the observed changes occurred at wavelengths above 600 nm. This data was then used to determine the difference in color appearance that would result from individual lamps, whether halophosphor or triphosphor, when compared to a reference source comprising a blackbody (Planckian) illuminant having a distribution temperature of 4000° K.

The calculated data was used to render an index to measure the suitability of fluorescent lamps for cyanosis detection. The resulting index, as stated above, is known as the Cyanosis Observation Index (COI). More specifically, the COI is an open ended numerical scale ranking the suitability of a lamp for the purpose of visual detection of the presence or onset of cyanosis. The index is a dimensionless number, calculated from the spectral power distribution of a lamp, and is established by calculating the change in color appearance of fully oxygenated blood, i.e, 100% oxygen saturation, and of oxygen-reduced, cyanosed blood, as assessed by a test lamp, and as compared to a reference lamp. According to the current standard, AS/NZS 1680, lamps exhibiting lower index values are better suited for use in hospital and clinical evaluation settings for detecting the presence of cyanosis. The limiting value on the index is 3.3, with values greater than 3.3 being unacceptable for use in clinical observation settings. Specifically, the standard requires the use of lamps meeting a COI of not more than 3.3, and having a Correlated Color Temperature (CCT) between 3300° K and 5300° K.

It was found that triphosphor lamps are not well suited for this purpose because they have limited emittance in the 600 nm to 700 nm wavelength range where most changes in the reflectance of blood with changing oxygenation take place. This type of lamp generally renders a COI of about 5.3 at 4100° K, well above the limit set by the standard. Cool White halophosphor fluorescent lamps, popular for many other applications and uses, generally exhibit a COI of 15.5.

Correlated color temperature (CCT) is a measure of the "shade" of whiteness of a light source by comparison to a blackbody in equilibrium at a specific temperature. The CCT of typical incandescent lighting is 2700° K which is yellowish-white. Halogen lighting has a CCT of 3000° K. Fluorescent lamps are manufactured to a range of CCT values by altering the mixture of phosphors inside the tube. Warm-white fluorescents have a CCT of 2700° K and are popular for residential lighting. Neutral-white fluorescents have a CCT of 3000° K or 3500° K. Cool-white fluorescents have a CCT of 4100° K and are popular for office lighting. Daylight fluorescents have a CCT of 5000° K to 6500° K, which is bluish-white. CCT can be calculated using the ccx,ccy coordinates of a light source as plotted on the graph shown in FIG. 2, which is the CIE standard chromaticity diagram, as known to those skilled in the art.

The color rendering index (CRI) of a lamp is a measure of its effect on the color appearance of objects in comparison with their appearance under a standard source, such as daylight or a blackbody. Since the spectrum of incandescent lamps is very close to a standard blackbody, they have a CRI of 100. Fluorescent lamps achieve CRI ranging from about 50 to about 95+. Some fluorescent lamps have low red light emission, especially those with high CCT values. These lamps can make skin appear less pink, and hence "unhealthy" as compared to evaluation under incandescent lighting. For example, a 6800° K halophosphate tube (an extreme example) will make reds appear dull red or even brown. Since the human eye is relatively less efficient at detecting red light, light sources with increased energy in the red part of the spectrum, will have reduced overall luminous efficacy.

The COI standard discussed above and set forth in AS/NZS 1680.2: 1997 is used today as a guideline for lighting in hospitals and clinical observation areas where visual observation of a patient's condition is rendered. While some lamps that exhibit acceptable COI values are commercially available, few if any generate a spectrum whose COI is well below the 3.3 standard. One manner of optimizing lamp performance for the purpose of cyanosis detection is to optimize the combination of light sources employed in a lamp or illumination system in order to generate a spectrum of white light whose COI is less than 3.3, preferably less than 2.0, and more preferably less than 1.5. A lamp meeting this lower COI value, if attainable, would provide an observing care-giver with the capability to readily and accurately detect and treat conditions indicated by the presence of cyanosis.

As can be seen from the foregoing, it is critical to patient assessment that lamps selected for use in clinical observation areas meet the COI requirement set in AS/NZS 1680.2. It is further shown that many commercially available lamps prove unsuitable because they exhibit a COI value higher than 3.3, and sometimes much higher.

It would be desirable to have a method to quantifiably predict a combination of light sources that will provide an illumination system capable of generating light that achieves the desired lower COI values, and preferably COI values of less than 2.0 and more preferably less than 1.0, and also meets the required CCT of between about 3300° K and 5300° K. It would also be desirable to have illumination systems that include a combination of light sources meeting this same standard.

SUMMARY OF THE DISCLOSURE

In an embodiment, a solid-state light emitting-based illumination system is provided which, when energized, exhibits a correlated color temperature (CCT) in the range of between about 3300° K and about 5300° K, and exhibits a COI of less than 3.3. The system comprises two or more solid-state elements, and is configured to provide a total light that appears white when energized, the combined light having preselected spectral fraction values such that when combined the emission meets the specified CCT and COI requirements.

In another embodiment, a solid-state light emitting-based illumination system is provided, wherein the solid-state light emitting-based system includes light emitting diodes (LED), organic light emitting diodes (OLED), and other light emitting elements, and which, when energized, exhibits a correlated color temperature (CCT) in the range of between about 3300° K and about 5300° K, and exhibits a COI of less than 3.3. The system comprises two or more solid-state elements, and is configured to provide a total light spectrum that appears white when energized, the combined light having preselected spectral fraction values such that when combined the emission meets the specified CCT and COI standards.

In still another embodiment, the solid-state light emitting-based illumination system exhibits a COI of less than 2.0, and in some instances less than 1.5.

In yet another embodiment, the solid-state light emitting-based illumination system includes at least three solid-state elements emitting color bands that blended together emit white light. Further, at least one of the solid-state elements emits light in the red portion of the visible spectrum between about 600 nm and 700 nm.

In an embodiment, a solid-state light emitting-based illumination system is provided which, when energized, exhibits a correlated color temperature (CCT) in the range of between about 3300° K and about 5300° K, for example of about 4100° K, and exhibits a COI of less than 2.0. The system comprises two or more solid-state elements, and is configured to provide a total light that appears white when energized, the combined light having preselected spectral fraction values such that when combined the emission meets the specified CCT and COI requirements.

In yet another embodiment, a method of configuring an illumination system is provided, wherein the system comprises one or more solid-state light-emitting elements, the system having a total white light spectrum with a CCT in the range of between about 3300° K and about 5300° K and a COI of less than 3.3. The method comprises at least the steps of: (a) identifying a target chromaticity point having a ccy value within +/−0.02 of the blackbody locus and having a (ccx, ccy) point lying within the CCT range of 3300° K and 5300° K; (b) identifying a target COI value desired for the lighting system; (c) identifying a target CRI value desired for the lighting system; (d) choosing a plurality, n, of light sources having distinct emissions ($ccx_i$, $ccy_i$), wherein i=2 to n, such that the color triangle formed by at least one set of three ($ccx_i$, $ccy_i$) values contains the target chromaticity point, or for that scenario where only two light sources having distinct emission are chosen, a line connecting their ($ccx_i$, $ccy_i$) values that includes the target (ccx, ccy); (e) combining the light sources from (d) in a ratio such that the target (ccx, ccy) value is obtained; (f) calculating the COI using the AS/NZS 1680 standard; (g) calculating the CCT from the ccx.ccy coordinates of the combined light sources from (d); (h) calculating the CRI of the system using CIE, Method of Measuring and Specifying Color Rendering Properties of Light Sources ($2^{nd}$ ed.), Publ. CIE No. 13.2 (TC-3.2) and 15.2 *Colorimetry*, Bureau Central de la CIE, Paris, 1974; (i) comparing the calculated COI to the target COI from (b); (j) comparing the calculated CRI to the target CRI from (c); and (k) if the target values are not achieved, returning to step (d) and choosing additional or replacement light sources that satisfy the condition of step (d) and repeating steps (e)-(j) until the targets are met, or, if the target values are achieved, constructing and measuring the illumination system to ensure compliance with the target values established in steps (a)-(c).

Other features and advantages of this invention will be better appreciated from the following detailed description.

DETAILED DESCRIPTION OF THE PREFERRED EMBODIMENTS

Figure 1:
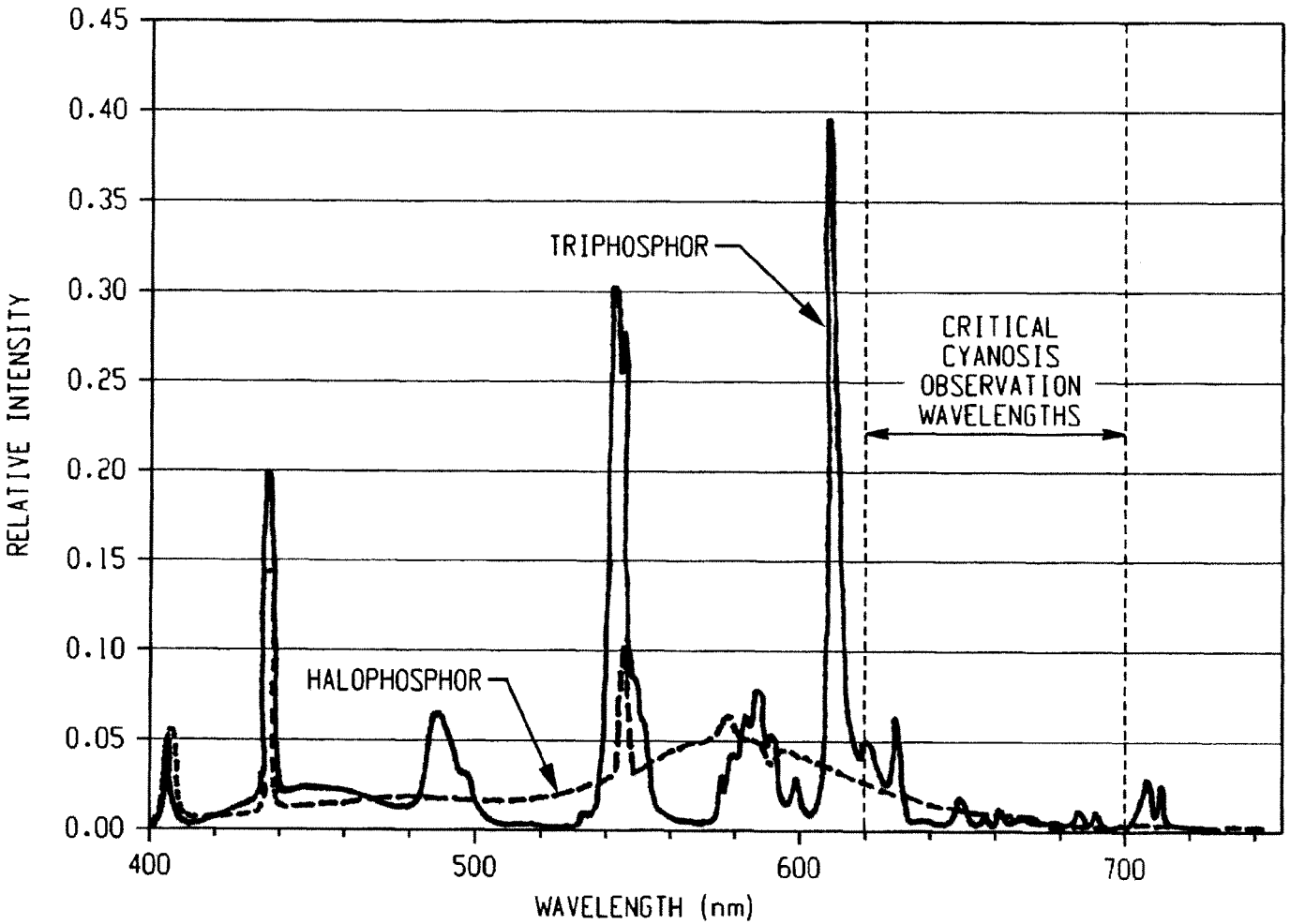
FIG. 1 is a comparison of the spectral power distribution of various lighting sources.

Throughout the specification, certain terms and phrases may be used that have the definitions recited herein. Terms or phrases not defined herein will be attributed with the meaning of such as would be understood by one skilled in the field of art to which the invention pertains.

As used herein, approximating language may be applied to modify any quantitative representation that may vary without resulting in a change in the basic function to which it is related. Accordingly, a value modified by a term or terms, such as "about" and "substantially," may not be limited to the precise value specified, in some cases. The modifier "about" used in connection with a quantity is inclusive of the stated value and has the meaning dictated by the context (for example, includes the degree of error associated with the measurement of the particular quantity). "Optional" or "optionally" means that the subsequently described event or circumstance may or may not occur, or that the subsequently identified material may or may not be present, and that the description includes instances where the event or circumstance occurs or where the material is present, and instances where the event or circumstance does not occur or the material is not present. The singular forms "a", "an" and "the" include plural referents unless the context clearly dictates otherwise. All ranges disclosed herein are inclusive of the recited endpoint and independently combinable. Finally, as used herein, the phrases "adapted to," "configured to," and the like refer to elements that are sized, arranged or manufactured to form a specified structure or to achieve a specified result.

The term "clinical observation area" as used herein refers to any area, whether in a hospital or other facility, where patients may be observed and or treated, and where determination of the presence or absence of cyanosis is necessary or desirable for the assessment of the patient.

Color is observed as a result of the reflection of light from objects. Put simply, an object appears blue because it absorbs all of the non-blue light and reflects blue light back to the eyes of the viewer. Therefore, a light source having an absence of any specific color will not detect that color and the human eye will not perceive that color as being illuminated. When applying this principle to the detection of a bluish tint to skin, which we relate to the onset or presence of cyanosis, it is important to be sure that the light source includes emittance in the red portion of the visible spectrum, given that blood is naturally red. This portion of the spectrum lies at about 660 nm, which also correlates to the differences in spectral transmission of fully oxygenated and oxygen-depleted blood, which occurs between 600 nm and 700 nm, with an optimum at about 660 nm. This then relates back to the statement above that if a light source emits to much light at this optimum wavelength, or has too much red, the cyanosis may be masked and go undetected. Conversely, if the light output has too little red, the patient's skin may appear too dark, rendering a false positive. In one embodiment, a calculation method is provided for determining how to combine individual spectral fractions, from individual light sources, to achieve a perceived white light. Further, the white light emission will meet the criteria set forth by the AS/NZS 1680 standard for hospital lighting, which includes light emission having a Correlated Color Temperature (CCT) of between 3300° K and 5300° K and exhibiting a Cyanosis Observation Index (COI) of less than 3.3. Still further, the white light emission meeting the foregoing criteria will exhibit a CRI value of greater than about 70, and preferably greater than about 80.

As noted, in one embodiment an illumination system is provided which, when energized, exhibits a correlated color temperature (CCT) in the range of between about 3300° K and about 5300° K and a cyanosis observation index value (COI) of less than 3.3. The system may comprise a plurality of solid-state light-emitting elements, wherein at least two of these solid-state light-emitting elements have different color emission bands. The system is configured such that when it is energized, it provides a total light that appears white. The terms "illumination system", "lighting system" and "lamp" may be utilized substantially interchangeably herein to refer to any source of visible light that generates that visible light by blending the emissions from at least two solid-state light-emitting elements. In addition, the terms "solid-state light-emitting element" and "light source" may be utilized substantially interchangeably, and typically include any inorganic light emitting diode (e.g., LED), organic light emitting diode (e.g. OLED), inorganic electroluminescent device, laser diode, and combinations thereof, or the like, and wherein an "element" or "source" includes an coating, phosphor, filter or other modification that may be present in or on such element or source.

The term "solid state" refers commonly to light emitted by solid-state electroluminescence, as opposed to e.g. incandescent lamps (which use thermal radiation) or fluorescent and high intensity discharge lamps (which use a gaseous discharge). In broad outline, in solid-state light emitting elements, such as LEDs, light is emitted from a solid, often a semiconductor, rather than from a metal or gas, as is the case in traditional incandescent lamps, fluorescent lamps, and other discharge lamps. Unlike traditional lighting sources, lamps composed of solid-state light emitting elements can potentially create visible light with less heat and less energy dissipation. In addition, the solid-state nature provides for greater resistance to shock, vibration and wear, thereby increasing the device durability significantly. Of more importance herein, however, is the capability to tailor the spectra of an illumination system when using solid-state light-emitting elements due to the better-defined peak wavelength, or color spectrum, of the solid-state light-emitters, as is discussed below. Even though incandescent and fluorescent sources are not generally categorized as "solid-state" in the industry, to some degree they are solid-state given that in conventional fluorescent lamps most light is generated in the solid state fluorescent phosphor coating of the tube, and in conventional incandescent lamps light is generated in the solid-state tungsten filament.

In one embodiment, the light source may comprise one or more light emitting diodes (LED). An LED is usually defined as a solid-state semiconductor device that converts electrical energy directly into light. The output of an LED is a function of its physical construction, the materials used, and the exciting current. Output may be in the ultraviolet, the visible, or in the infrared regions of the spectrum. The wavelength of the emitted light is determined by the band gap of the materials in the p-n junction, and is usually characterized as having a peak (or dominant) wavelength, $\lambda_p$, at which the emission is maximum, and a distribution of wavelengths, encompassing the peak wavelength, over which the emission is substantial. The distribution of wavelengths is typically characterized by a Gaussian probability density function given by $$\frac{1\exp}{\Delta\lambda_{1/2}\sqrt{2\pi}} - \frac{(\lambda-\lambda_p)^2}{2\Delta\lambda_{1/2}^2}$$

where $\Delta\lambda_{1/2}$ is the Gaussian half-width of the distribution function. As such, each LED is typically characterized by its perceived color, for example, violet, blue, cyan, green, amber, orange, red-orange, red, etc. Perceived color is principally determined by the LED peak wavelength, $\lambda_p$, even though the distribution is not monochromatic, but rather exhibits a "color band", which as used herein refers to a finite spread in wavelengths of a few times $\Delta\lambda_{1/2}$, where $\Delta\lambda_{1/2}$ is typically in the range of about 5 to 50 nm. The entire wavelength range over which the LED emits perceivable light is substantially more narrow than that of the entire range of visible light, which generally encompasses from about 390 nm to about 750 nm, so that each LED is perceived as a specific non-white color. Additionally, individual LED devices that are nominally rated to have the same peak wavelength typically exhibit a range of peak wavelengths due to manufacturing variability. LED devices may be grouped into color bins that limit the peak wavelength to a range of allowable peak wavelengths encompassing the intended peak wavelength. A typical range of peak wavelengths defining the limits of a color bin for colored LED devices is about 5 to 50 nm. Because LED lamps comprise LED devices of many different color bands and individual colors, this type of light source offers many more choices from which to select those light sources that will be included in the illumination system in accord with an embodiment of the invention. By careful selection of the light sources used in an illumination system, for example by selecting specific LED devices, a combination of peak wavelengths can be created to generate a lamp spectrum with a COI well below the 3.3 standard, and even less than 1.0. The lamp having this feature, and exhibiting a CCT of between 3300° K and 5300° K, provides an illumination system that permits improved accuracy in assessing patient condition, particularly cyanosis.

In another embodiment, the light source may comprise one or more OLED devices. As is generally understood, an OLED device typically includes one or more organic light emitting layers disposed between electrodes, e.g., a cathode and a light transmissive anode, formed on a substrate, often a light-transmissive substrate, these layers together forming a device known as an "organic electroluminescent element". The light-emitting layer emits light upon application of a current across the anode and cathode. Upon the application of an electric current, electrons may be injected into the organic layer from the cathode, and holes may be injected into the organic layer from the anode. The electrons and the holes generally travel through the organic layer until they recombine at an electroluminescent center, typically an organic molecule or polymer, resulting in the emission of a light photon, usually in the ultraviolet or visible regions of the spectrum. Therefore, as used herein, the term "organic electroluminescent element" or "OLED" generally refers to a device (e.g., including electrodes and active layers) comprising an active layer or layers having an organic material (molecule or polymer) that exhibits the characteristic of electroluminescence. The chemical composition of the organic electroluminescent material determines the "band gap" and the corresponding distribution of wavelengths of the emitted light from the luminescent center. Similar to the color band that characterizes the perceived color of an LED, the distribution of wavelengths emitted from an organic electroluminescent layer also produces a color band. However, unlike the case of the typically Gaussian shaped distribution of the LED color band, the color band of the organic electroluminescent element may have multiple peak wavelengths, and possibly a broader spectral width. Nonetheless, each luminescent center within an organic electroluminescent layer may be characterized by a perceived color that, having a finite distribution of wavelengths narrower than that of the entire range of visible light, may be referred to as a color band. There may be one or more different compositions of luminescent centers within each organic light-emitting layer so that each light-emitting layer may emit light in one or more color bands.

Because the color band of an OLED is generally less defined than that of an LED, there are fewer individual, distinct colored OLED devices available for combination in a light source, as compared to the number of LED devices available for combination. In fact, the emission spectra of an OLED may be even broader than that of fluorescent lamps. For this reason, OLED devices are generally less optimum light sources for use herein because the emission spectra of this type of source offers fewer individual colors to choose from to create the desired combination of spectral fractions needed to create a white light having the desired CCT and COI. Nonetheless, by careful selection of the light sources used in an illumination system, for example by selecting specific OLED devices, in accord with the method provided herein, a combination of peak wavelengths may be created to generate a spectrum whose COI is well below the 3.3 standard, and even less than 1.0. The lamp having this feature, and exhibiting a CCT of between 3300° K and 5300° K, provides an illumination system that permits improved accuracy in assessing patient condition, particularly cyanosis.

While the primary focus of this disclosure is based on the use of solid-state emitters, it is to be understood that other known light sources may be selected using the calculation method provided herein. One such light source is a fluorescent light source. A fluorescent lamp or fluorescent tube is a gas-discharge lamp that utilizes electricity to excite mercury vapor. The excited mercury atoms produce short-wavelength ultraviolet light that subsequently causes a phosphor to fluoresce, producing visible light. The spectrum of light emitted from a fluorescent lamp is the combination of light directly emitted by the mercury vapor in conjunction with light emitted by the phosphorescent coating. The spectral lines from the mercury emission and the phosphorescence give a combined spectral distribution of light. The relative intensity of light emitted in each narrow band of wavelengths over the visible spectrum has different proportions. Colored objects are perceived differently under light sources with differing spectral distributions. For example, some people find the color quality produced by some fluorescent lamps on the market today to be harsh and displeasing. A healthy person can sometimes appear to have an unhealthy skin tone under such fluorescent lighting. The extent to which this phenomenon occurs is related to the light's spectral composition, and may be gauged by its correlated color temperature (CCT), color rendering index (CRI) and COI, as discussed hereinabove.

As compared to LED sources, fluorescent sources generally exhibit a broader color band, having less defined peak wavelengths and including more of the spectrum in each. Therefore, fluorescent sources offer fewer individual colors to choose from when combining colors to create the perceived white light having the desired CCT and COI. Nonetheless, and in accord with the foregoing discussion regarding OLED light sources, by careful selection of the light sources used in an illumination system, for example by selecting specific fluorescent light sources, a combination of peak wavelengths can be created to generate an overall spectrum whose COI is below the 33 standard. The lamp having this feature, and exhibiting a CCT of between 3300° K and 5300° K, provides an illumination system that permits improved accuracy in assessing patient condition, particularly cyanosis. Similarly, high intensity discharge (HID) lamps, may be employed, though they represent the most difficult to optimize for purposes of the invention disclosed more fully below.

In light of the foregoing, it will be understood by the skilled artisan that the calculation technique defined herein is equally applicable to any type of light source and will allow one to choose a combination of light sources that will generate light having a perceived white color and exhibiting a CCT of between 3300° K and 5300° K and a COI of less than 3.3, regardless of whether the light source is a solid-state light-emitting element or one that emits light from a metal material or gas discharge, such as are used in incandescent, high intensity or fluorescent lamps. Therefore, use of the term "solid-state light emitting element" or any part thereof is also applicable to other types of illumination systems as defined or suggested above.

In accordance with some embodiments of the invention, the illumination system may include two or more solid-state light emitting elements, and they may be arranged in a stacked or overlaid configuration, or even in tandem. In some other embodiments, an illumination system that comprises at least one photoluminescent material (typically selected from, but not limited to, phosphor, quantum dot, and combinations thereof), for converting light from at least one of the solid-state light emitting elements to a different wavelength is included. Still further embodiments include an illumination system that comprises at least one filter for modifying the total light of the illumination system. Suitable filters may possibly include materials which depress certain regions of the spectrum of the total light of the illumination system, such as neodymium-containing glass filters.

Figure 2:
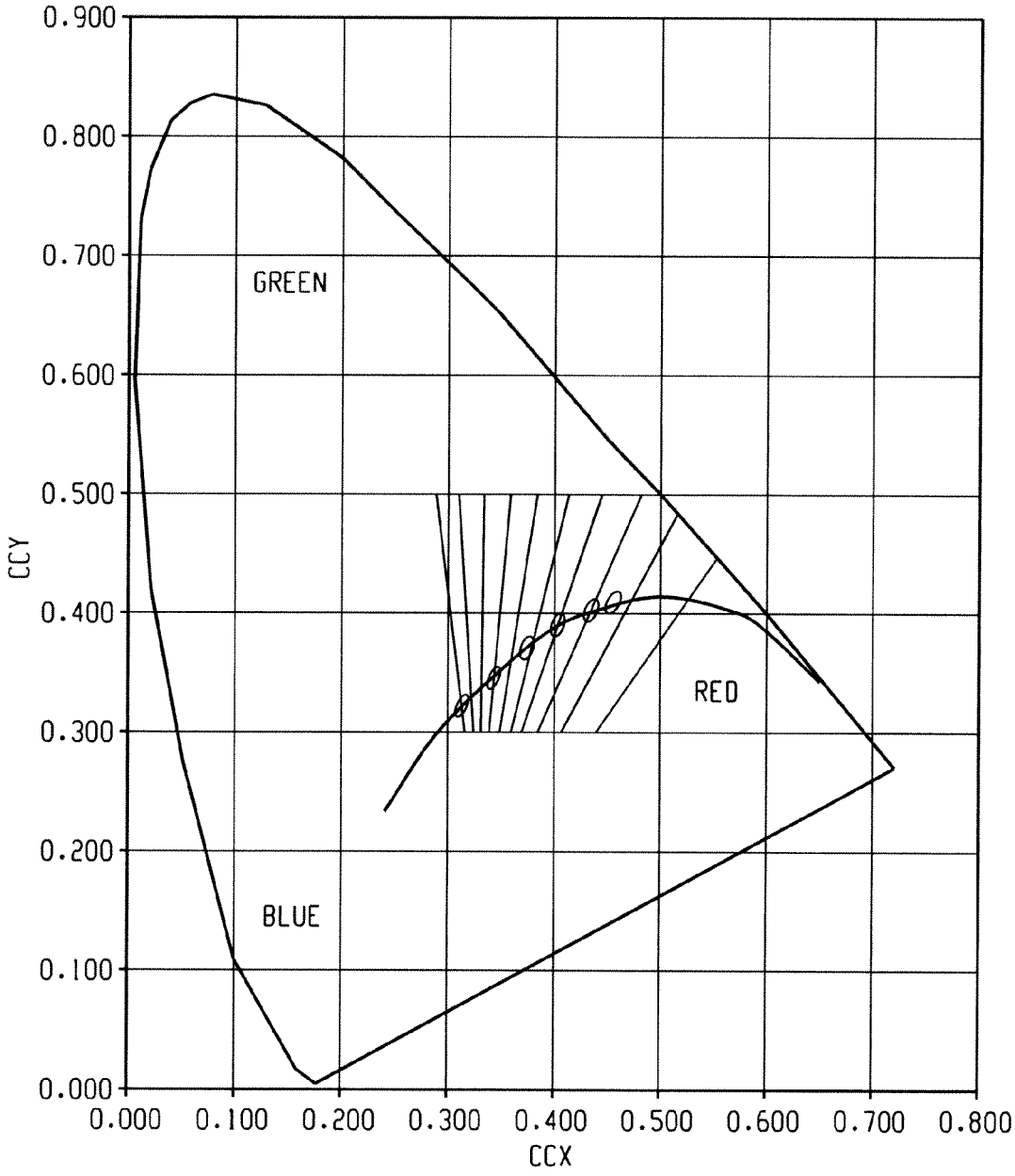
FIG. 2 sets forth the CIE standard chromaticity diagram.
Figure 3:
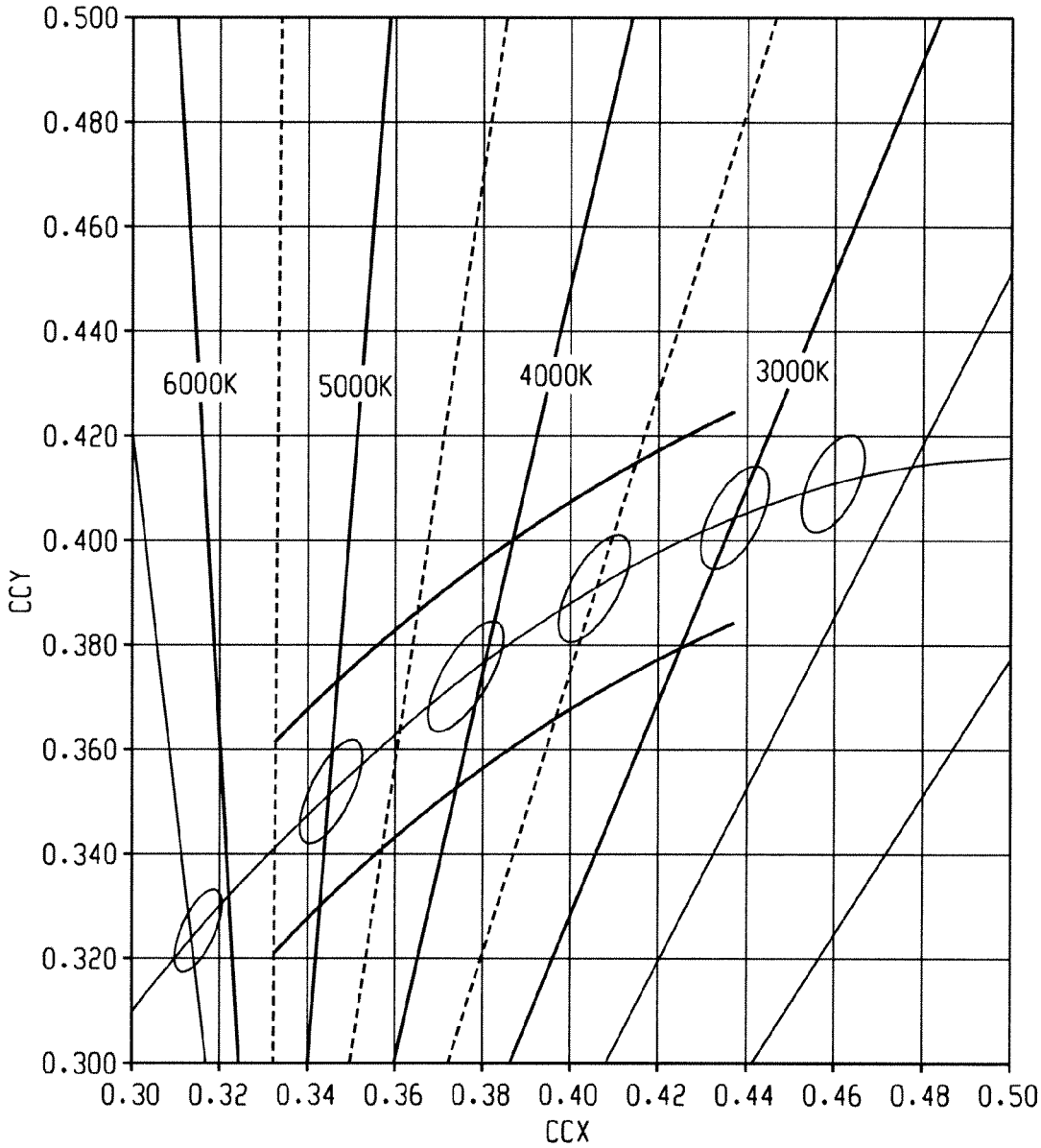
FIG. 3 is a diagram of the locus of blackbody chromaticities on the ccx,ccy-diagram of FIG. 2, known as the Planckian locus.

In embodiments of the disclosure, illumination systems will exhibit a CCT of between 3300° K and 5300° K, and a COI of not greater than 3.3. The color appearance of an illumination system, per se (as opposed to objects illuminated by such illumination system) is described by its chromaticity coordinates or color point, which, as would be understood by those skilled in the art, can be calculated from its spectral power distribution according to standard methods. This is specified according to CIE, Method of Measuring and Specifying Color Rendering Properties of Light Sources (2nd ed.), Publ. CIE No. 13.2 (TC-3.2) and 15.2 *Colorimetry*, Bureau Central de la CIE, Paris, 1974. (CIE is the International Commission on Illumination, or, Commission Internationale d'Eclairage). The CIE standard chromaticity diagram is a two-dimensional graph having ccx and ccy coordinates, as set forth in FIG. 2. This standard diagram includes the color points of blackbody radiators at various temperatures. The locus of blackbody chromaticities on the ccx, ccy-diagram is known as the Planckian locus. FIG. 3 is an exploded diagram of that portion of FIG. 2 corresponding to the Plankian locus. Because light sources with equal CCT may lie significantly above or below the Planckian locus and provide undesirable non-white illumination, in addition to specifying CCT, it is necessary to specify ccx, ccy chromaticity points near the blackbody locus to obtain near white illumination. According to an embodiment, there is provided an illumination system which provides a total light comprising a combination of solid-state light emitters, for example LED devices, having specified peak wavelengths that together generate a spectrum of emitted light which has a chromaticity point near the blackbody locus, i.e., has a ccy value within +/−0.02 of the blackbody locus, and meets the AS/NZS 1680 standard, i.e., will provide white light with a CCT of between 3300° K and 5300° K and a COI of less than 3.3. Illumination systems meeting these parameters provide light that is useful in illuminating a patient such that the onset or presence of cyanosis can be readily discerned.

Figure 4:
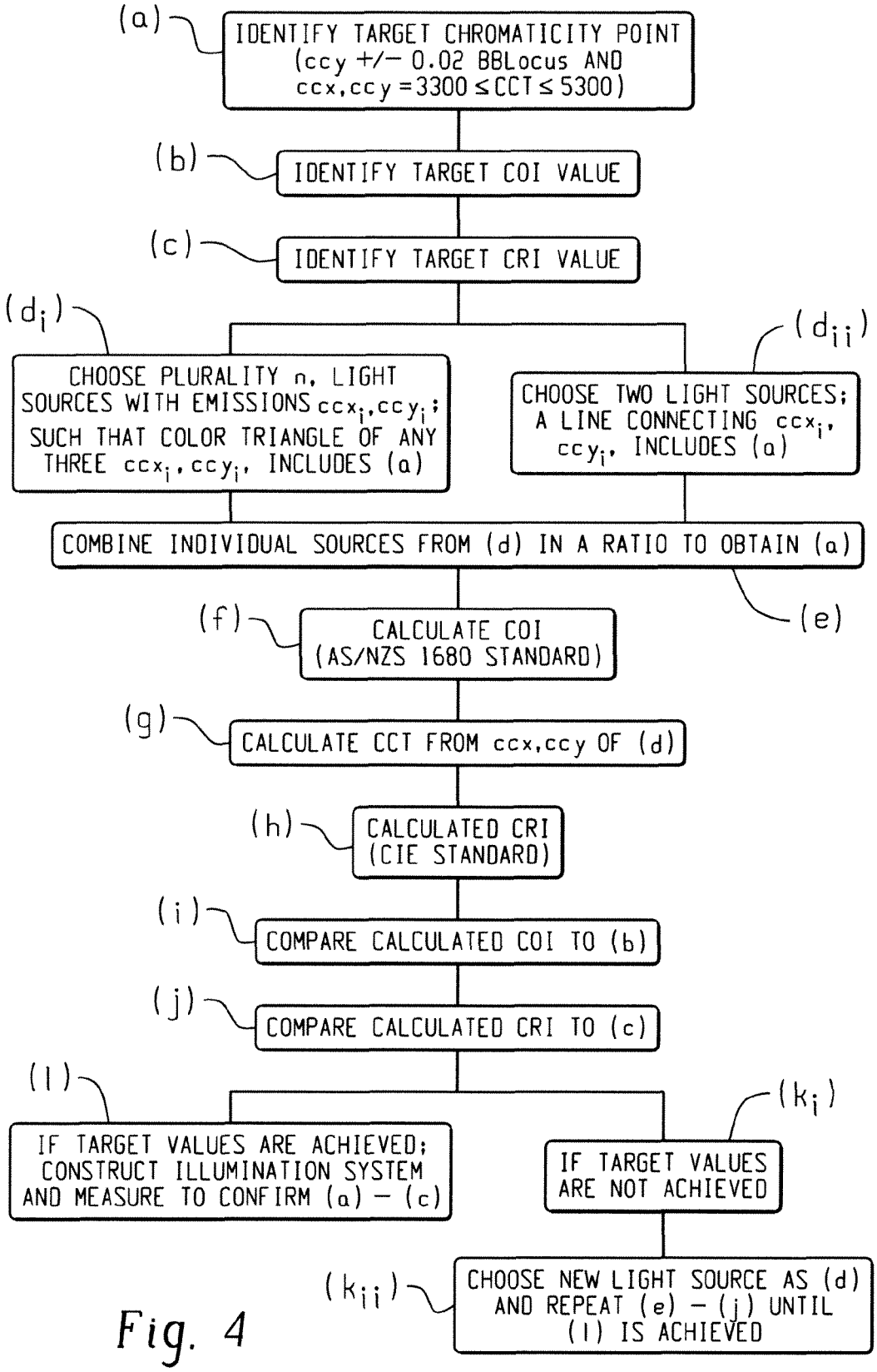
FIG. 4 is a block diagram of a method of manufacturing an illumination system, in accordance with embodiments of the disclosure.

In another embodiment, a method is provided for manufacturing an illumination system comprising at least two solid-state light-emitting elements having a total white light with a CCT of between about 3300° K and about 5300° K and a COI of not greater than 3.3. Referring now to FIG. 4, there is shown a block flow diagram, schematically setting forth this method. In general, the method comprises the steps of: (a) identifying a target chromaticity point having a ccy value within +/−0.02 of the blackbody locus and having a (ccx, ccy) point lying within the CCT range of 3300° K and 5300° K; (b) identifying a target COI value desired for the lighting system; (c) identifying a target CRI value desired for the lighting system; ($d_i$) choosing a plurality, n, of light sources having distinct emissions ($ccx_i$, $ccy_i$), wherein i=2 to n, such that the color triangle formed by at least one set of three ($ccx_i$, $ccy_i$) values contains the target chromaticity point, or ($d_{ii}$) for that scenario where only two light sources having distinct emission are chosen, a line connecting their ($ccx_i$, $ccy_i$) values that includes the target (ccx, ccy); (e) combining the light sources from (d) in a ratio such that the target (ccx, ccy) value is obtained; (f) calculating the COI using the AS/NZS 1680 standard; (g) calculating the CCT from the ccx,ccy coordinates of the combined light sources from (d); (h) calculating the CRI of the system using CIE, Method of Measuring and Specifying Color Rendering Properties of Light Sources ($2^{nd}$ ed.), Publ. CIE No. 13.2 (TC-3.2) and 15.2 *Colorimetry*, Bureau Central de la CIE, Paris, 1974; (i) comparing the calculated COI to the target COI from (b); (j) comparing the calculated CRI to the target CRI from (c); and (k) if the target values are not achieved, returning to step (d) and choosing additional or replacement light sources that satisfy the condition of step (d) and repeating steps (e)-(j) until the targets are met, or, if the target values are achieved, (l) constructing and measuring the illumination system to ensure compliance with the target values established in steps (a)-(c).

In accordance with some embodiments of the invention, a plurality of solid-state light-emitting elements in the illumination system are arranged in a grid, close packed, or other regular pattern or configuration. Non-limiting examples of such a regular pattern include grids in a hexagonal, rhombic, rectangular, square, or parallelogram configuration, or a regular spacing around the perimeter or the interior of a circle, square, or other multi-sided plane geometric shape, for example. For optimized color mixing, it may sometimes be desirable to keep the incidence of light-emitting elements of the same color being located adjacent to one another to a minimum. However, it may not always be possible to avoid same-color adjacency. Such illumination system construction is known to those skilled in the art and is not a limiting factor of the invention.

In accord with the method provided, an illumination system may be created meeting the parameters provided. The following Examples are provided as a guide, and are not intended to be in any way limiting of the full breadth of the invention.

EXAMPLE 1

Figure 5A:
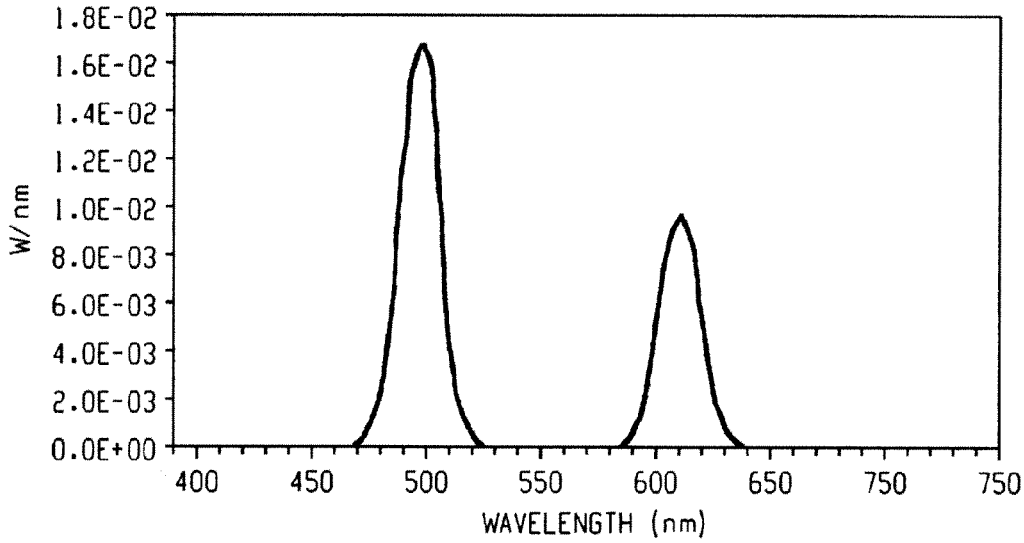
FIGS. 5*a* and 5*b* are the blend spectral distribution for the initial and corrected 2 light source illumination system of Example 1.
Figure 5B:
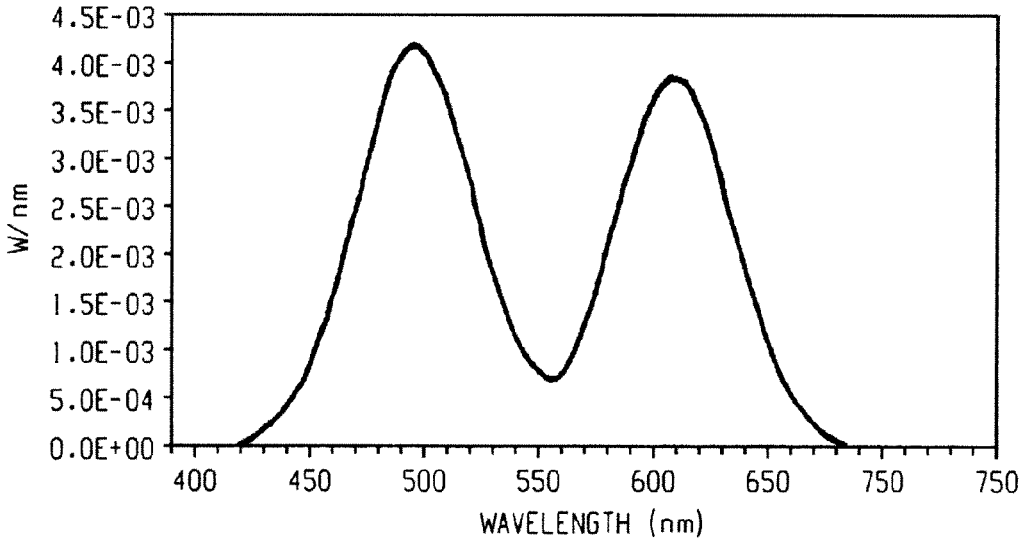

In this Example 1, an illumination system in accord with an embodiment was created as follows: Two light sources were selected, one emitting at 496.3 nm and the other at 610.5 nm, with Full Width at Half Maximum (FWHM) of about 19 nm, i.e., the peak intensity distribution can be described by a Gaussian distribution with a maximum at the indicated peak wavelength and whose width at one-half of the maximum is about 19 nm. The light was blended to obtain a ccx, ccy in accord herewith, of 0.380, 0.380 which correlates to an ANSI standard 4100K. This selection and blending satisfied steps (a) through (e) of the process, as presented in FIG. 4. The COI was calculated to be 9.51, clearly greater than the target value of 3.3 or lower (Steps f, i). Further, CRI was calculated to be −26, which was also clearly unsatisfactory for purposes of the disclosure (Steps g, j). The FWHM of each peak was adjusted to 60 nm (Step k), following which the peak positions were adjusted to 497.8 nm and 612.9 nm, respectively (Step k). The ratio of the peak intensities was chosen to obtain ccx, ccy coordinates of 0.380, 0.380, and the COI was once again calculated and found to be 3.3 (Steps f, i), while the CRI was calculated to be 56 (Step g, j). Although in this Example 1 acceptable COI and ccx, ccy targets were obtained, the CRI was determined to be too low. FIG. 5*a* provides the blend spectral distribution for the initial illumination system and 5*b* provides the blend spectral distribution for the corrected illumination system, in keeping with the foregoing and as set forth in Table 1. This Example uses FWHM that are too broad for typical LEDs. Though an illumination system exhibiting acceptable parameters according to the disclosure can be created using only two light sources, for purposes of illustration and example additional light sources will be added in the next example.

EXAMPLE 2

Figure 6A:
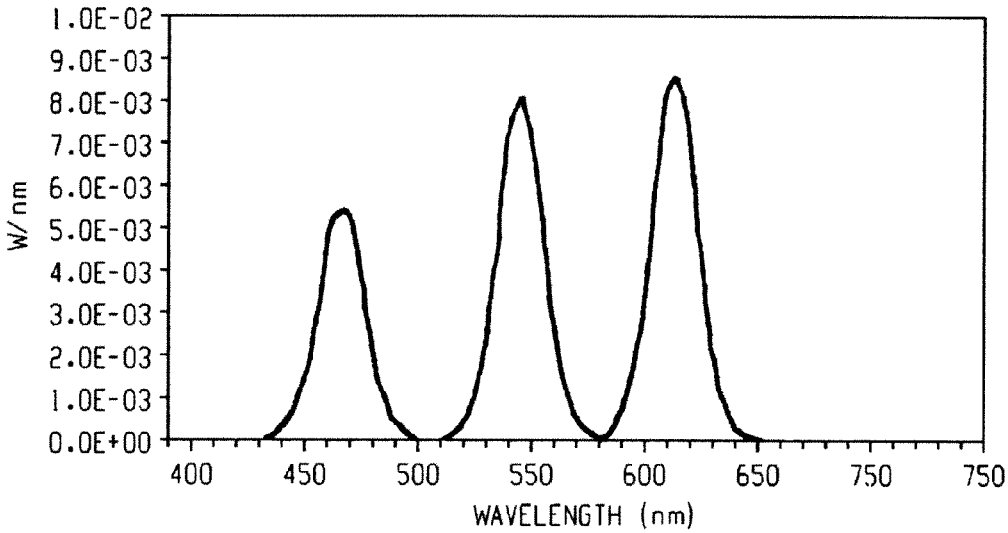
FIGS. 6*a* and 6*b* are the blend spectral distribution for the initial and corrected illumination system of Example 2.
Figure 6B:
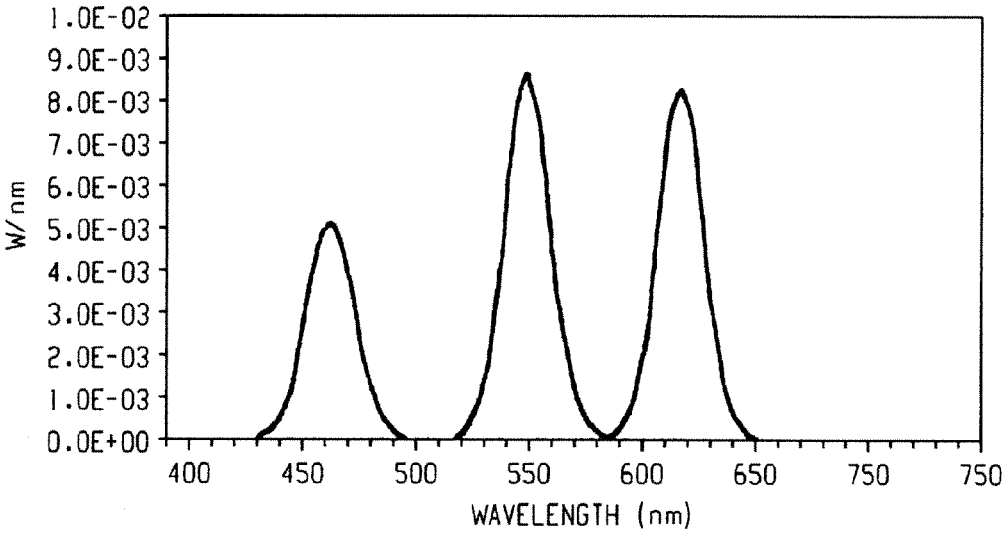

A second illumination system was created, in keeping with the method set forth above in Example 1, but this time using three light sources. The light sources chosen included one emitting at 466.3 nm, another at 545.5 nm, and the third at 614.1 nm with FWHM of about 24 nm. The ratio of peak intensities was chosen to obtain ccx, ccy coordinates of 0.380, 0.380 (Steps a-e). Using these sources, the COI was calculated to be 3.3, which is the upper limit for this parameter (Step f, i). CRI was also calculated and was 86 (Step g, j). A lower COI was desired. Therefore, peak positions were then adjusted to 462.2 nm, 549.4 nm, and 617.4 nm, respectively (Step $j_{ii}$, k). The ratio of peak intensities was again chosen to obtain ccx,ccy of 0.380, 0.380 (Step e). The COI was then calculated to be 1.7, well below the upper limit of 3.3 (Steps f, i). CRI was calculated to be 80 (Step g, j). FIG. 6*a* provides the blend spectral distribution for the initial illumination system and 6*b* provides the blend spectral distribution for the corrected illumination system, in keeping with the foregoing and as set forth in Table 1. Given the foregoing, this Example provides an illumination system suitable for use in clinical observation in accord with an embodiment of this disclosure.

EXAMPLE 3

Figure 7A:
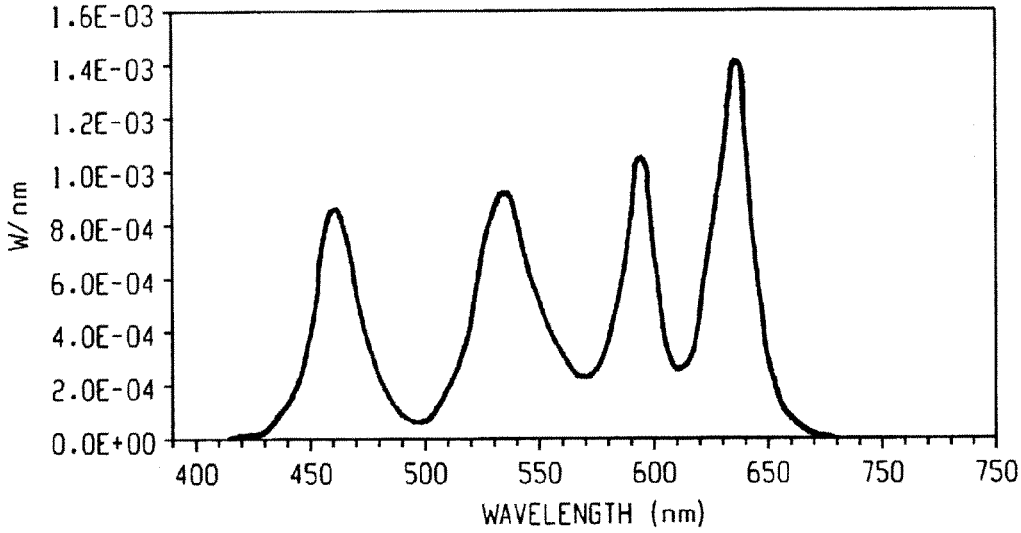
FIGS. 7*a* and 7*b* are the blend spectral distribution for the initial and corrected illumination system of Example 3.
Figure 7B:
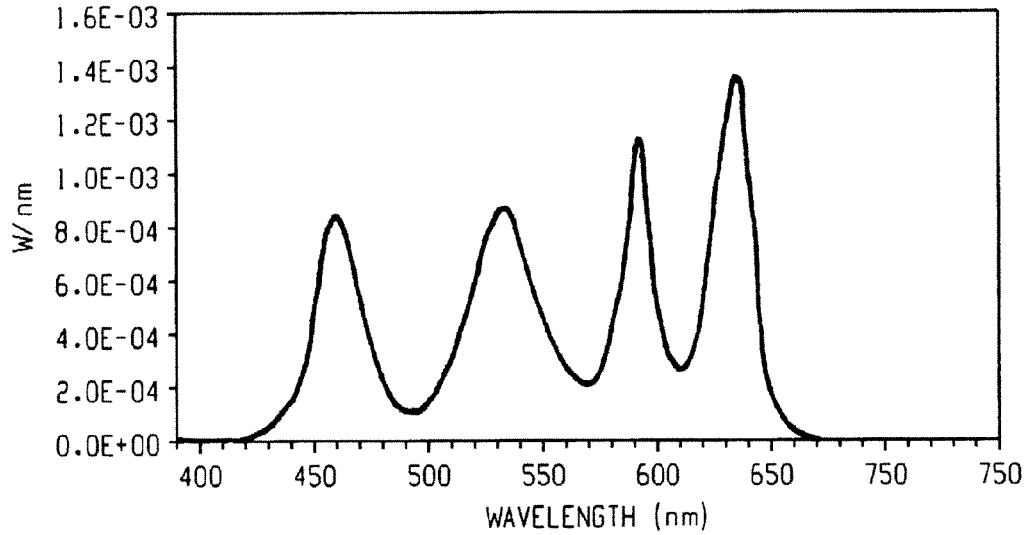

Yet another illumination system was created, again in keeping with the process used in Example 1, however, this example includes the use of spectra of LumiLeds LEDs, available commercially from Philips LumiLeds Lighting Company. This illumination system included 4 light sources, emitting at 461 nm, 535 nm, 594 nm, and 636 nm, with FWHM of about 22, 33, 16 and 18 nm, which is typical of a commercially available product. The ratio of peak intensities was chosen to obtain ccx, ccy of 0.380, 0.380 (Steps a-e). For this system, COI was calculated to be 0.93 (Step f, i), and CRI to be 92 (Step g, j). A fifth source, emitting at 514 nm (FWHM 35 nm), was then added to the illumination system (Step k), and the ratio of peak intensities again chosen to obtain ccx, ccy of 0.380, 0.380 (Step a-e). COI was then recalculated and found to be 1.13 (Steps f, i), and the CRI recalculated to be 94 (Step g, j). At this point, the 461 nm light source was replaced with a 452 nm-emitting light source (FWHM 22 nm) (Step k), and the ratio of peak intensities was again adjusted to obtain ccx, ccy of 0.380, 0.380 (Step a-e). The COI was calculated yet again and found to be 0.31 (Steps f, h), and the CRI was calculated to be 89 (Step g, i). FIG. 7*a* provides the blend spectral distribution for the initial illumination system and 7*b* provides the blend spectral distribution for the corrected illumination system, in keeping with the foregoing and as set forth in Table 1.

EXAMPLE 4

Figure 8A:
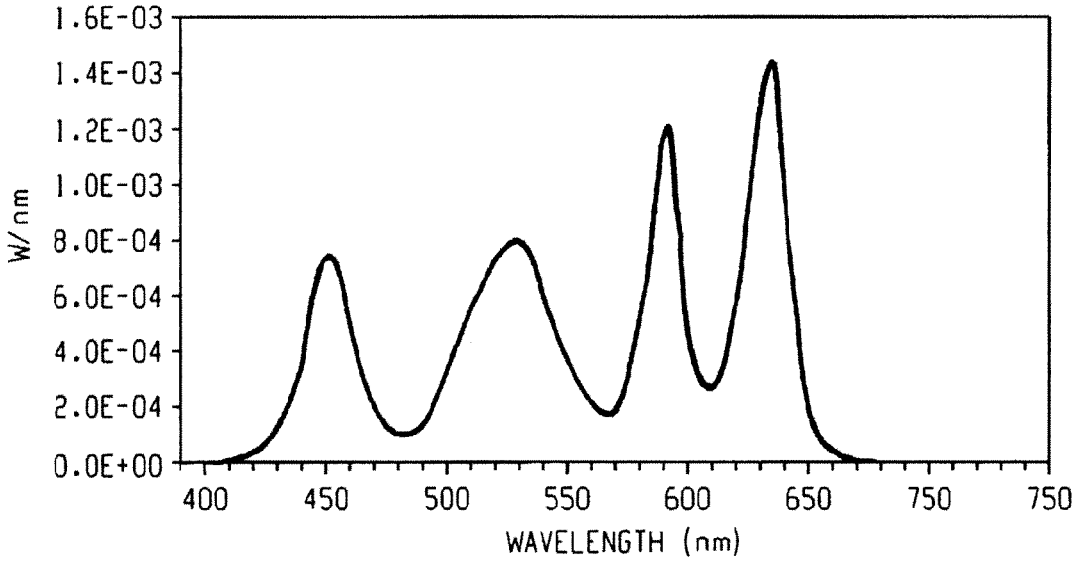
FIG. 8*a*-8*c* are the blend spectral distributions for the illumination systems of Example 4.
Figure 8B:
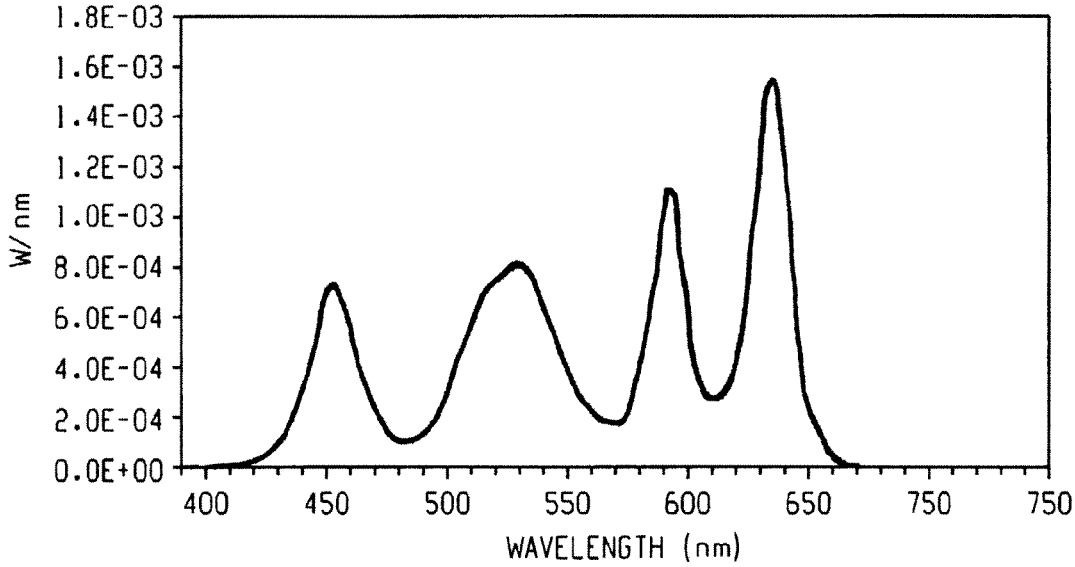
Figure 8C:
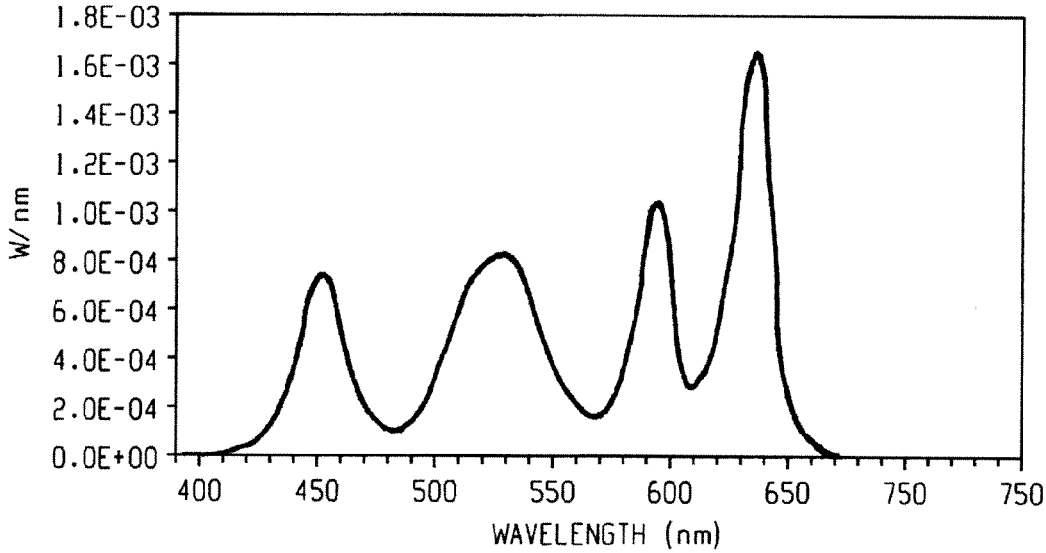

Additional illumination systems were created, again in keeping with the process used in Example 3, to illustrate the importance of iterative optimization of the spectra. One such illumination system is set forth in this Example 4. This illumination system included 5 light sources, emitting at 452 nm, 514 nm, 535 nm, 594 nm, and 636 nm, with FWHM as indicated in Example 3, as shown in Table 1. The ratio of peak intensities was chosen to obtain ccx, ccy of 0.380, 0.380 (Steps a-e). For illumination system "A" the ratio of peak intensities provides a COI of 3.5, greater than the target value of 3.3. By slight adjustments of the peak intensity ratios, as shown for System "B", it can be seen that the COI has been adjusted to 2.0. With regard to System "C" it is shown that with additional slight adjustment, a COI of 0.31 can be obtained, representing the most superior value. FIGS. 8*a*-8*c* provide the blend spectral distribution created by blending the light sources, A, B and C, respectively, set forth in Table 1 and in accord with the spectral fractions provided for each system. As can be seen, the dominant emission peak is at about 636 nm, which is within the desired range of about 600 nm to about 700 nm. This same characteristic is exhibited by the illumination system corresponding to Example 3.

TABLE 1

| Example | Peak Wavelength (nm) | Spectral Fraction | FWHM (nm) | CRI | COI |
|---|---|---|---|---|---|
| 1 - Initial | 496.3 | 0.635 | 19 | | |
| | 610.5 | 0.365 | 19 | | |
| | | | | −26 | 9.51 |
| Corrected | 497.8 | 0.521 | 60 | | |
| | 612.9 | 0.479 | 60 | | |
| | | | | 56 | 3.3 |

TABLE 1-continued

| Example | Peak Wavelength (nm) | Spectral Fraction | FWHM (nm) | CRI | COI |
|---|---|---|---|---|---|
| 2 - Initial | 466.3 | 0.246 | 24 | | |
| | 545.5 | 0.365 | 24 | | |
| | 614.1 | 0.389 | 24 | | |
| | | | | 86.5 | 3.3 |
| Corrected | 462.2 | 0.231 | 24 | | |
| | 549.4 | 0.393 | 24 | | |
| | 617.4 | 0.376 | 24 | | |
| | | | | 80.0 | 1.7 |
| 3 - Initial | 461 | 0.210 | 22 | | |
| | 535 | 0.328 | 33 | | |
| | 594 | 0.169 | 16 | | |
| | 636 | 0.293 | 18 | | |
| | | | | 92.3 | 0.93 |
| Corrected | 461 | 0.207 | 22 | | |
| | 514 | 0.037 | 35 | | |
| | 535 | 0.292 | 33 | | |
| | 594 | 0.182 | 16 | | |
| | 636 | 0.282 | 18 | | |
| | | | | 94.0 | 1.13 |
| 4 - A | 452 | 0.165 | 22 | | |
| | 514 | 0.182 | 35 | | |
| | 535 | 0.177 | 33 | | |
| | 594 | 0.156 | 16 | | |
| | 636 | 0.321 | 18 | | |
| | | | | 80.2 | 3.5 |
| B | 452 | 0.167 | 22 | | |
| | 514 | 0.181 | 35 | | |
| | 535 | 0.176 | 33 | | |
| | 594 | 0.171 | 16 | | |
| | 636 | 0.305 | 18 | | |
| | | | | 83.9 | 2.0 |
| C | 452 | 0.171 | 22 | | |
| | 514 | 0.170 | 35 | | |
| | 535 | 0.186 | 33 | | |
| | 594 | 0.187 | 16 | | |
| | 636 | 0.186 | 18 | | |
| | | | | 88.5 | 0.31 |
| 5 | 452 | 0.101 | 22 | | |
| | 461 | 0.090 | 22 | | |
| | 514 | 0.159 | 35 | | |
| | 535 | 0.206 | 33 | | |
| | 594 | 0.196 | 16 | | |
| | 636 | 0.247 | 18 | | |
| | | | | 90.0 | 0.10 |

The illumination systems represented by the data from Examples 1 and 2, and as set forth in Table 1, are based on theoretical Gaussian distributions with indicated peak wavelengths and full width at half maximum (FWHM) values. The illumination systems represented by the data from Examples 3-5 are based on summed spectra of LumiLeds LEDs, available commercially from Philips LumiLeds Lighting Company, i.e., 452 represents a light source emitting a dominant peak at 452 nm. The total of the spectral fractions of the combined light sources equals 1.0. CCT for each illumination system was determined to be 4033° K, well within the required 3300-5300° K range, by plotting the ccx, ccy coordinates of the blend, which are 0.380, 0.380, respectively, on the graph shown in FIG. 3. It is noted that the ccy coordinate is within the allowed +/−0.02 range of the blackbody locus.

EXAMPLE 5

Figure 9:
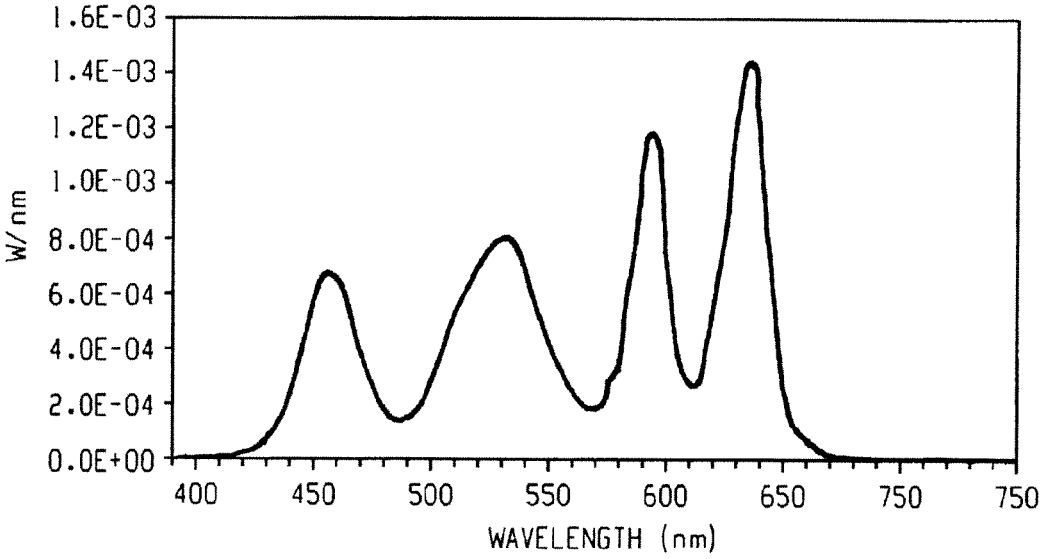
FIG. 9 is the blend spectral distribution for the illumination system of Example 5.

Yet another illumination system was created, again in keeping with the process used in Example 1. This illumination system included 6 light sources, emitting at 452 nm, 461 nm, 514 nm, 535 nm, 594 nm, and 636 nm, with FWHM of about 22, 22, 35, 33, 16 and 18 nm typical of commerically available product. The ratio of peak intensities was chosen to obtain ccx, ccy of 0.380, 0.380 (Steps a-e). For this system, COI was calculated to be 0.10 (Step f, i), and CRI to be 90 (Step g, j). FIG. 9 sets forth the blend spectral distribution of the illumination system of this Example 5.

COMPARATIVE EXAMPLES

The following Table 2 sets forth the relevant data for six commercially available light sources. Lamps D-F are fluorescent lamps. Each presents parameters well outside of the acceptable ranges disclosed herein for Hospital Lighting use. It is noted that lamp "D", though it meets the CCT value and exhibits ccx, ccy coordinates of 0.380/0.380 as with acceptable lamps nonetheless exhibits a COI well above 3.3, indicating that the spectral fractions would need to be adjusted. Examples "E" and "F" also exhibit COI values well above the acceptable limit of 3.3. While these fluorescent lamps do not meet the COI standard, other fluorescent lamps may be able to provide a COI of about 3.3, but none are known to provide a COI of as low as 2.0 or lower. Examples G-I are each blue LEDs having a phosphor coating, available commercially from Nichia Corporation, a Japanese entity. The spectral fraction for these chips was not available. "G" exhibited a CCT of 4400 but COI of 10.06, clearly well above the desired range. "H" and "I" exhibit CCT values (4079; 3429) and COI values (2.01; 1.35) within the desired ranges. However, in order to provide a lamp for hospital/clinical use, a large number of these chips would need to be used in combination. The current invention provides a method for configuring an illumination system using multiple solid state light emitting elements.

TABLE 2

| LAMP | SPECTRAL FRACTION | CCT | ccx, ccy | COI |
|---|---|---|---|---|
| D - Triphosphor | YEO - 0.332<br>LAP - 0.496<br>BAM - 0.146 | 4033 | 0.380/0.380 | 6.46 |
| E - Cool White | 1.000 | 3916 | 0.388/0.392 | 14.73 |
| F - Warm White | 1.000 | 2919 | 0.444/0.408 | 13.20 |
| G - Phosphor on Blue LED | n/a | 4397 | 0.363/0.358 | 10.06 |
| H - Phosphor on Blue LED | n/a | 4079 | 0.373/0.359 | 2.01 |
| I - Phosphor on Blue LED | n/a | 3429 | 0.411/0.396 | 1.35 |

As such, the Comparative Examples show that many commercially available lamps do not meet the COI standard as set forth by AS/NZS, thus supporting the need to be able to choose light sources according to the method provided herein for creating an illumination system that does in fact meet the AS/NZS standard for hospital lighting.

The foregoing examples provide a guide for one skilled in the art to create a suitable illumination system for use in clinical observation settings. In the Examples in accord with the invention, the illumination system was optimized to achieve ccx, ccy coordinates of 0.380, 0.380, respectively, using different light sources and/or the same light sources but in different spectral fractions. Also, COI varied in each Example. The acceptable illumination systems were in all cases within the AS/NZS standard. The comparative examples provide detail of lamps outside the invention.

It is noted that for each Example provided, the ccx, ccy value was selected to be 0.380, 0.380, corresponding to an ANSI lighting value/color temperature of 4100° K. The actual value/color temperature is measured to be 4033° K. Therefore, the illumination systems in accord with the disclosure exhibit a CCT falling within the specified parameter of 3300° K to 5300° K.

It will be appreciated that the number of solid-state light-emitting elements cited above is dependent on the intensity of the elements as well as their peak wavelengths and distribution of wavelengths. Accordingly, the present invention is not limited in the number of solid-state light-emitting elements that could be used to build a desired combined spectrum of light. Thus, the invention may comprise use of solid-state light-emitting elements having at least two different color bands, i.e., solid-state light emitting elements emitting violet, blue, cyan, green, amber, yellow, orange, red-orange, and/or red or other intermediate or mixtures of color bands may be included. In these embodiments, the combined solid-state light emitting elements produce white light, having a spectrum exhibiting a CCT of between about 3300° K and about 5300° K and a COI of less than 3.3.

The illumination system in accordance with embodiments of this disclosure further comprises a substrate for supporting the plurality of solid-state light-emitting elements. In general, such substrate may comprise a heat dissipating material capable of dissipating heat from said system. The general purpose for such substrate includes providing mechanical support and/or thermal management and/or electrical management and/or optical management for the plurality of solid-state light-emitting elements. Substrates can comprise one or more of metal, semiconductor, glass, plastic, and ceramic, or other suitable material. Printed circuit boards provide one specific example of a substrate. Other suitable substrates include various hybrid ceramics substrates and porcelain enamel metal substrates. Furthermore, one can render a substrate to be light reflecting, for example, by applying white masking on the substrate. In some cases, the substrate can be mounted in a base. An example of a suitable base includes the well-known Edison screw base.

In embodiments of the invention, the illumination system will further include leads for providing electric current to at least one of the plurality of solid-state light emitting elements. The leads may comprise a portion of an electrical circuit. As is generally known, illumination devices having a plurality of solid-state light-emitting elements (such as LED devices of different colors) may be controlled in both intensity and color by appropriate application of electrical current. Thus, the person skilled in this field would broadly understand the electrical circuitry needed to provide power to solid-state light-emitting elements. The present invention is not intended to be limited to a particular circuit, but rather, by characteristics of the total light of the illumination system.

In certain embodiments of the invention, the illumination system may further include at least one controller and at least one processor. Usually such processor is configured to receive a signal from a controller to control intensity of one or more of the solid-state light-emitting elements. A processor can include, e.g., one or more of microprocessor, microcontroller, programmable digital signal processor, integrated circuit, computer software, computer hardware, electrical circuit, programmable logic device, programmable gate array, programmable array logic; and the like. In some case, such controller is in communication with a sensor receptive to one or both of the total light emission (that is, the total light of the illumination system), or the temperature of the solid-state light-emitting elements. A sensor can be, for example, a photodiode or a thermocouple. The processor may in turn control (directly or indirectly) electric current to the solid-state light-emitting elements. In further embodiment, the system can further include a user interface coupled to the controller to facilitate adjustment of the total light emission or the spectral content of the emitted light.

According to some embodiments, the illumination system can comprise an envelope to at least partially enclose the plurality of solid-state light-emitting elements. Typically such envelope is substantially transparent or translucent in the direction of the intended light output. Materials of construction for such envelope may include one or more of plastic, ceramic, metal, composites, light-transmissive coatings, glass, or quartz. Such envelope can have any shape, for example, bulb shaped, dome shaped, hemispherical, spherical, cylindrical, parabolic, elliptical, flat, helical, or other.

The illumination system may include an optical facility that performs a light-affecting operation upon the light emitted by one or more of the solid-state light-emitting elements. As used herein, the term "optical facility" includes any one or more elements that can be configured to perform at least one light-affecting operation. Such a light affecting operation may include, but is not limited to, one or more selected from mixing, scattering, attenuating, guiding, extracting, controlling, reflecting, refracting, diffracting, polarizing, and beam-shaping. In other words, an optical facility has broad meaning sufficient to include a wide variety of elements that affect light. These light-affecting operations offered by the optical facility can be helpful in effectively combining the light from each of the solid-state light-emitting elements (where a plurality is employed), so that the total light appears white, and preferably homogeneous in color appearance as well. Operations such as mixing and scattering are especially effective to achieve homogeneous white light. Operations such as guiding, extracting, and controlling are intended to refer to light-affecting operations that extract the light from the light-emitting elements, for maximizing luminous efficiency. These operations may have other effects as well. It is understood that there is possible overlap between the terms describing the light-affecting operation (e.g., "controlling" may include "reflecting"), but the person skilled in the art would understand the teens used.

In some cases, the illumination system may include a scattering element or optical diffuser to mix light from two or more solid-state light-emitting elements. Typically, such scattering element or optical diffuser is selected from at least one of film, particle, diffuser, prism, mixing plate, or other color-mixing light guide or optic; or the like. A scattering element (e.g., an optical diffuser) may assist in obscuring individual RGB (red, blue, green, or other color) structure of different-colored solid-state light emitting elements, so that the color of the light source and the illumination upon a surface appears substantially spatially uniform in apparent color to the viewer.

In some embodiments, the optical facility can include a light guiding or shaping element selected from lens, filter, iris, and collimator, and the like. Alternatively, the optical facility can include an encapsulant for one or more of the solid-state light-emitting elements that are configured to mix, scatter or diffuse light. In another alternative, the optical facility includes a reflector or some other kind of light-extracting elements (e.g., photonic crystals or waveguide).

As noted, according to some embodiments of the invention, one may employ a material that encapsulates individual solid-state light emitting elements (e.g., LED chips), in order to scatter or diffuse light, or to make homogeneous light. Usually, such an encapsulating material is substantially transparent or translucent. The encapsulating medium may, in some instances, be composed of a vitreous substance or a polymeric material, e.g., epoxy, silicone, acrylates, and the like. Such an encapsulating material may typically also include particles that scatter or diffuse light, which can assist in mixing light from different solid-state lighting elements. Particles which scatter or diffuse light can be any appropriate size and shape, as would be understood by those skilled in the art, and can be composed of, for example, an inorganic material such as silicon oxide, silicon, titania, alumina, indium oxide, tin oxide, or other metal oxides, and the like. In alternative embodiments, one may employ other types of diffusers and mixers to diffuse light, or to make homogeneously colored light. They could be engineered diffuser films, for example, such as those used within the liquid crystal display (LCD) industry, that are prism films on various polymeric materials. In addition, it is also possible to guide and/or shape the LED light using different other optical components to further optimize color mixing within this light source. Suitable optical components include, for example, various lenses (concave, convex, planar, "bubble", fresnel, etc.) and various filters (polarizers, color filters, etc.).

While examples have been presented utilizing LED light-emitting elements, one of skill can build or adapt a lamp from a combination of LED devices and/or OLED devices and/or other solid-state light-emitting elements having meeting the AS/NZS standard when blended, by ascertaining the spectral patterns of the lamps made in accordance with this example. One would choose light emitting elements which match the spectra of the LED devices used in the inventive combination described in the example above. It is surprising that the proper selection of solid state light-emitting elements and blending of their output will provide spectra with the same, or even improved, illuminating characteristics for the detection of cyanosis in a patient.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. An illumination system for use in clinical observation areas, said illumination system comprising at least two light sources that each emit differing color bands, the illumination system exhibiting a correlated color temperature (CCT) of between about 3300° K and about 5300° K on the blackbody locus or within a ccy distance of +/−0.02 of the blackbody locus and a cyanosis observation index (COI) of less than 3.3.

2. The illumination system of claim 1 wherein the at least two light sources comprise solid-state light-emitting devices.

3. The illumination system of claim 1 wherein the at least two light sources comprise three or more light emitting diodes.

4. The illumination system of claim 1 wherein the at least two light sources emit color bands that together emit white light.

5. The illumination system of claim 1 wherein at least one of the at least two light sources emits light in the red portion of the visible spectrum between about 600 nm and about 700 nm.

6. The illumination system of claim 1 wherein the CCT is 4100° K.

7. The illumination system of claim 1 wherein the system further exhibits a CRI of at least about 80.

8. A lamp comprising the illumination system of claim 1.

9. The lamp of claim 8 wherein the COI value of the illumination system is less than 2.0.

10. The lamp of claim 8 wherein the COI value of the illumination system is less than 1.0.

11. The lamp of claim 8 wherein the COI value of the illumination system is less than 0.5.

12. The lamp of claim 8 comprising a combination of three or more LED devices, each LED emitting light having a distinct peak wavelength, such that upon being blended the lamp emits a white light having a spectrum whose COI is less than 3.3.

13. A method for providing a clinical observation area lighting system having a correlated color temperature (CCT) of between 3300° K and 5300° K and a cyanosis observation index (COI) of less than 3.3, the method comprising:

(a) identifying a target chromaticity point having a ccy value within +/−0.02 of the blackbody locus and having a (ccy, ccx) point lying within the CCT range of 3300° K and 5300° K;

(b) identifying a target COI value desired for the lighting system;

(c) identifying a target CRI value desired for the lighting system;

(d) choosing a plurality, n, of light sources having distinct emissions ($ccy_i$, $ccx_i$), wherein i=2 to n, such that the color triangle formed by at least one set of three ($ccy_i$, $ccx_i$) values contains the target chromaticity point, or for that scenario where only two light sources having distinct emission are chosen, a line connecting their ($ccy_i$, $ccx_i$) values that includes the target (ccy, ccx);

(e) combining the light sources from (d) in a ratio such that the target (ccy, ccx) value is obtained;

(f) calculating the COI of the lighting system using the AS/NZS 1680 standard;

(g) calculating the CCT of the lighting system from the ccx,ccy coordinates of the combined light sources from (d);

(h) calculating the CRI of the lighting system using CIE, Method of Measuring and Specifying Color Rendering Properties of Light Sources ($2^{nd}$ ed.), Publ. CIE No. 15.2 *Colorimetry*, Bureau Central de la CIE, Paris, 1974;

(i) comparing the calculated COI to the target COI from (b);

(j) comparing the calculated CRI to the target CRI from (c); and (k) if the target values are not achieved, returning to step (d) and choosing additional or replacement light sources that satisfy the condition of step (d) and repeating steps (e)-(j) until the targets are met, or, if the target values are achieved, constructing and measuring the lighting system to ensure compliance with the target values established in steps (a)-(c).

14. The method of claim 13 wherein the COI value of the lighting system is less than 2.0.

15. The method of claim 13 wherein the COI value of the lighting system is less than 1.0.

16. The method of claim 13 wherein the two or more light sources are selected from the group consisting of light emitting diodes, fluorescent lamps, organic light emitting diodes, high intensity discharge lamps or any combination thereof.

17. The method of claim 13 wherein the clinical observation area lighting system generates white light having a ccy of within +/−0.02 of the blackbody locus at a CCT of from about 3300 to about 5300° K.

18. The method of claim 17 wherein the clinical observation area lighting system has a CCT of 4100° K.

19. The method of claim 13 wherein at least one of the plurality of light sources emits light in the red portion of the visible spectrum between about 600 nm and about 700 nm.

20. The method of claim 13 wherein n is at least 3.

* * * * *